US011821431B2

(12) United States Patent
Ye et al.

(10) Patent No.: US 11,821,431 B2
(45) Date of Patent: Nov. 21, 2023

(54) CENTRALIZING FEATURES IN ELECTRICAL SUBMERSIBLE PUMP

(71) Applicant: Baker Hughes Oilfield Operations LLC, Houston, TX (US)

(72) Inventors: Zheng Ye, Claremore, OK (US); Michael Forsberg, Claremore, OK (US); Risa Rutter, Claremore, OK (US); Brett T. Williams, Claremore, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 0 days.

(21) Appl. No.: 17/091,686

(22) Filed: Nov. 6, 2020

(65) Prior Publication Data

US 2021/0140436 A1 May 13, 2021

Related U.S. Application Data

(60) Provisional application No. 62/933,131, filed on Nov. 8, 2019.

(51) Int. Cl.
*F04D 13/10* (2006.01)
*F04D 29/043* (2006.01)
(Continued)

(52) U.S. Cl.
CPC ..... *F04D 13/10* (2013.01); *F04D 29/043* (2013.01); *F04D 29/18* (2013.01); *F04D 29/548* (2013.01)

(58) Field of Classification Search
CPC ..... F04D 13/06; F04D 13/08; F04D 13/086; F04D 25/02; F04D 25/06; F04D 25/0686;
(Continued)

(56) References Cited

U.S. PATENT DOCUMENTS 2,407,348 A * 9/1946 Schott ..... F04D 29/20 403/354
7,144,549 B2 12/2006 Adams
(Continued)

FOREIGN PATENT DOCUMENTS

WO 2019209283 A1 10/2019

OTHER PUBLICATIONS

International Search Report and Written Opinion for PCT Application No. PCT/US2020/059469 dated Feb. 24, 2021.
(Continued)

*Primary Examiner* — Charles G Freay
*Assistant Examiner* — Chirag Jariwala
(74) *Attorney, Agent, or Firm* — BRACEWELL LLP; Keith R. Derrington

(57) ABSTRACT

An electrical submersible pump has a stack of diffusers within the housing, each of the diffusers having a conical upper shoulder and a conical lower shoulder. The lower shoulder of each of the diffusers is in abutment with the upper shoulder of an adjacent one of the diffusers. The upper and lower shoulders of each of the diffusers slope downward and outward relative to the axis. Impeller hubs have conical upper and lower ends. At least some of the upper ends of the hubs abut and transfer up thrust to the lower end of an adjacent one of the hubs. At least some of the lower ends of the hubs abut and transfer down thrust to the upper end of an adjacent one of the hubs.

19 Claims, 4 Drawing Sheets

(51) Int. Cl.
*F04D 29/54* (2006.01)
*F04D 29/18* (2006.01)

(58) Field of Classification Search
CPC ..... F04D 25/16; F04D 13/12; F04D 13/14; F04D 29/00; F04D 29/002; F04D 29/007; F04D 29/40–566; F04D 29/60–648; F04D 13/10; F04D 29/043; F04D 29/18
See application file for complete search history.

(56) References Cited

U.S. PATENT DOCUMENTS 8,043,051 B2 * 10/2011 Brunner ..... F04D 1/063 415/170.1
8,070,426 B2 12/2011 Brunner et al.
8,891,076 B2 * 11/2014 Sheth et al. ..... G01K 11/3206 356/73.1
9,903,475 B2 * 2/2018 Ruffin et al. ..... F16J 15/20
10,161,411 B1 * 12/2018 Gottschalk ..... F04D 29/16
10,344,866 B2 7/2019 Ye et al.
2012/0107114 A1 * 5/2012 Brunner ..... F04D 29/0413 415/229
2014/0294575 A1 * 10/2014 Morrison ..... F04D 29/648 415/199.2
2015/0071799 A1 * 3/2015 Johnson ..... F04D 29/0413 417/423.3
2015/0152877 A1 6/2015 Jayaram et al.
2015/0159666 A1 6/2015 Mcmanus et al.
2015/0226219 A1 * 8/2015 Johnson ..... F04D 13/10 417/423.3
2017/0002823 A1 * 1/2017 Gahlot ..... F04D 1/06
2017/0102009 A1 * 4/2017 Johnson ..... F04D 29/628
2017/0167498 A1 * 6/2017 Chang ..... F04D 1/063
2017/0241428 A1 * 8/2017 Ye ..... F16J 15/3284
2018/0195514 A1 * 7/2018 Cheah ..... F04D 29/708
2018/0306245 A1 * 10/2018 Howell ..... F16C 17/24
2018/0313359 A1 * 11/2018 Meyer ..... F01M 1/10
2019/0264540 A1 * 8/2019 Crane ..... H02K 5/1677
2020/0116152 A1 4/2020 Smith et al.

OTHER PUBLICATIONS

Saudi Arabian 1st Examination Report for SA Application Serial No. 522432374; Report dated Mar. 30, 2023 (original and machine translation).

* cited by examiner

CENTRALIZING FEATURES IN ELECTRICAL SUBMERSIBLE PUMP

CROSS REFERENCE TO RELATED APPLICATION

This application claims priority to provisional application Ser. No. 62/933,131, filed Nov. 8, 2020.

FIELD OF THE DISCLOSURE

This disclosure relates in general to electrical submersible well pumps (ESP), particularly to a centrifugal pump having diffusers and impeller hubs with tapered shoulders that stack on one another to centralize.

BACKGROUND

Electrical submersible well pumps are often used to pump well fluid from hydrocarbon producing wells. A typical ESP has a centrifugal pump. An ESP centrifugal pump has many stages, each stage having a diffuser and an impeller. The diffusers are stacked together in a pump housing and prevented from rotation. Each diffuser has a downward-facing shoulder that abuts an upward-facing shoulder of the diffuser directly below. A bearing at the top of the diffuser stack has threads that engage the pump housing, and when tightened, exert a compressive force on the stack of diffusers. The mating diffuser shoulders are perpendicular to the longitudinal axis of the pump housing.

In one type, each impeller and diffuser stage has an abrasion-resistant stage bearing that rotates with the shaft and typically transfers down thrust and up thrust to a mating diffuser. Each stage bearing has a rotating component that fits within a non-rotating bushing of a mating diffuser. In another type, hubs of the impellers contact each other to transfer down thrust and up thrust to impellers above and below.

A slight annular clearance exists between mating diffusers at the upper and lower shoulders. The annular clearance can result in slight misalignment of some of the diffusers with the axis of the housing. Because of tolerances between the shaft and impeller hubs, slight misalignment of the impellers relative to the axis can occur. Slight misalignment can cause heat generation of the bearings. The heat generation can be a problem particularly in higher speed pumps.

SUMMARY

An electrical submersible pump for pumping well fluid has a housing having a longitudinal axis. A stack of diffusers are within the housing, each of the diffusers having a conical upper shoulder and a conical lower shoulder. The lower shoulder of each of the diffusers is in abutment with the upper shoulder of an adjacent lower one of the diffusers.

In the embodiments shown, a taper angle of the upper shoulder and of the lower shoulder of each of the diffusers is in a range from 10 to 30 degrees relative to a plane perpendicular to the axis. The upper shoulder and the lower shoulder of each of the diffusers slope downward and outward relative to the axis.

In the embodiments shown, the upper end of each of the diffusers has a rim. The upper shoulder is spaced below the rim, defining a neck extending from the upper shoulder to the rim. The lower end of each of the diffusers slides over the neck of an adjacent lower one of the diffusers.

A drive shaft extends through the housing along the axis. Each impeller has a hub mounted to the shaft for rotation in unison and axially movable relative to the shaft. In the second embodiment each of the hubs have conical upper and lower ends. At least some of the upper ends of the hubs abut and transfer up thrust to the lower end of an adjacent upper one of the hubs. At least some of the lower ends of the hubs abut and transfer down thrust to the upper end of an adjacent lower one of the hubs.

In the second embodiment, an up thrust runner is mounted to the shaft for rotation in unison. The up thrust runner has a conical lower end that is abutted by the upper end of an adjacent lower one of the hubs. A down thrust runner is mounted to the shaft for rotation in unison. The down thrust runner has a conical upper end that is abutted by the lower end of an adjacent upper one of the hubs. This embodiment has means for transferring up thrust from the up thrust runner to the housing and for transferring down thrust from the down thrust runner to the housing.

In the embodiment shown the means for transferring thrust includes a down thrust bearing mounted in the housing for non-rotation relative to the housing. The down thrust bearing has an upper side that is abutted by the down thrust runner during down thrust. An up thrust bearing mounted in the housing has a lower side abutted by the up thrust runner during up thrust.

In the embodiment shown, the thrust transferring means includes an up thrust shell mounted in the stack of diffusers between two of the diffusers and above at least one of the impellers. The up thrust shell has an outer wall with conical upper and lower shoulders. The upper shoulder of the up thrust shell is in abutment with the lower shoulder of an adjacent upper one of the diffusers. The lower shoulder of the up thrust shell is in abutment with the upper shoulder of an adjacent lower one of the diffusers. The up thrust bearing is mounted in the up thrust shell.

The thrust transferring means also includes a down thrust shell mounted in the stack of diffusers between two of the diffusers and below at least one of the impellers. The down thrust shell has an outer wall with conical upper and lower shoulders. The upper shoulder of the down thrust shell is in abutment with the lower shoulder of an adjacent upper one of the diffusers. The lower shoulder of the down thrust shell is in abutment with the upper shoulder of an adjacent lower one of the diffusers. The down thrust bearing is mounted in the down thrust shell.

In the second embodiment, the lower end of the up thrust runner, the upper end of the down thrust runner, and the upper and lower shoulders of each of the thrust shells slope downward and outward relative to the axis.

DETAILED DESCRIPTION OF THE DISCLOSURE

Figure 3:
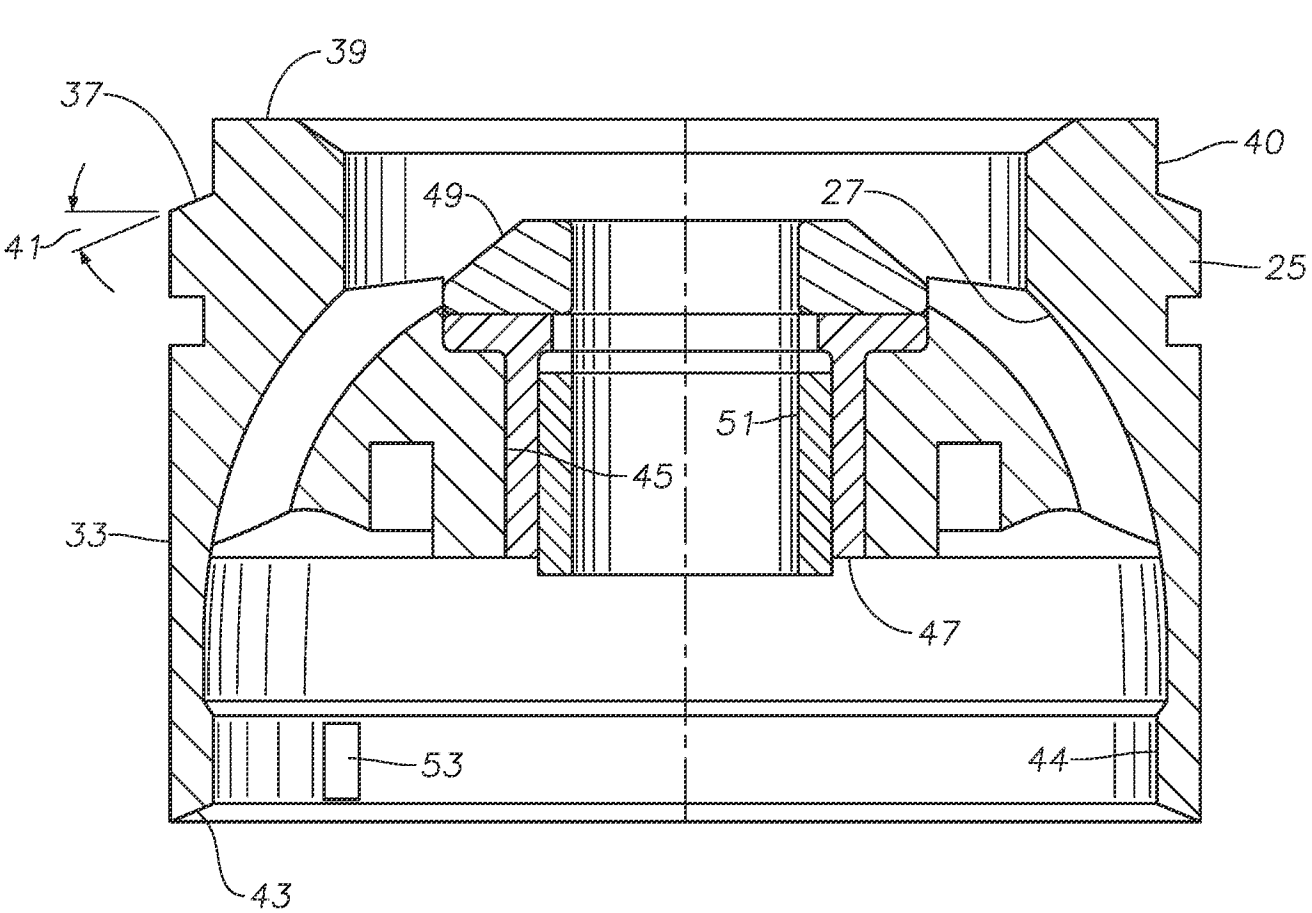
FIG. 3 is a sectional view of one of the diffusers and one set of impeller bearings of FIG. 2, shown removed the pump.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" and the like bare used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
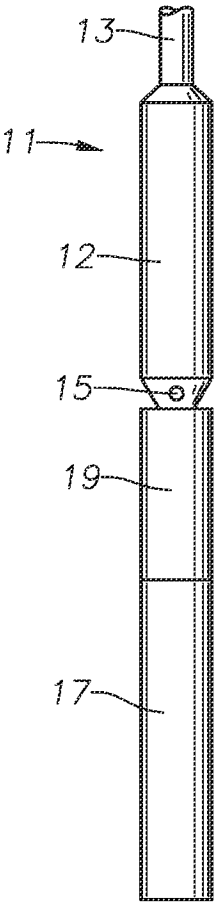
FIG. 1 is a schematic side view of an electrical submersible pump assembly in accordance with this disclosure.

FIG. 1 illustrates an electrical well pump assembly (ESP) 11 of a type typically used for oil well pumping operations. ESP 11 includes a centrifugal pump 12 having a large number of stages, each of the stages having an impeller and a diffuser. Pump 12 may be suspended in a well on a string of production tubing 13. Pump 12 has an intake 15 and discharges into production tubing 13. Alternatively, pump 12 could be suspended on coiled tubing, in which case the discharge would be in an annulus surrounding the coiled tubing.

ESP 11 also includes an electrical motor 17 for driving pump 12. Motor 17 connects to pump 12 via a seal section 19. Motor 17 is filled with a dielectric lubricant, and a pressure equalizer reduces a pressure differential between the dielectric lubricant and well fluid on the exterior. The pressure equalizer may be within seal section 19 or in a separate module. Intake 15 may be at the lower end of pump 12, in the upper end of seal section 19, or in a separate module. Also, ESP 11 may also include a gas separator, and if so, intake 15 would be in the gas separator.

Figure 2:
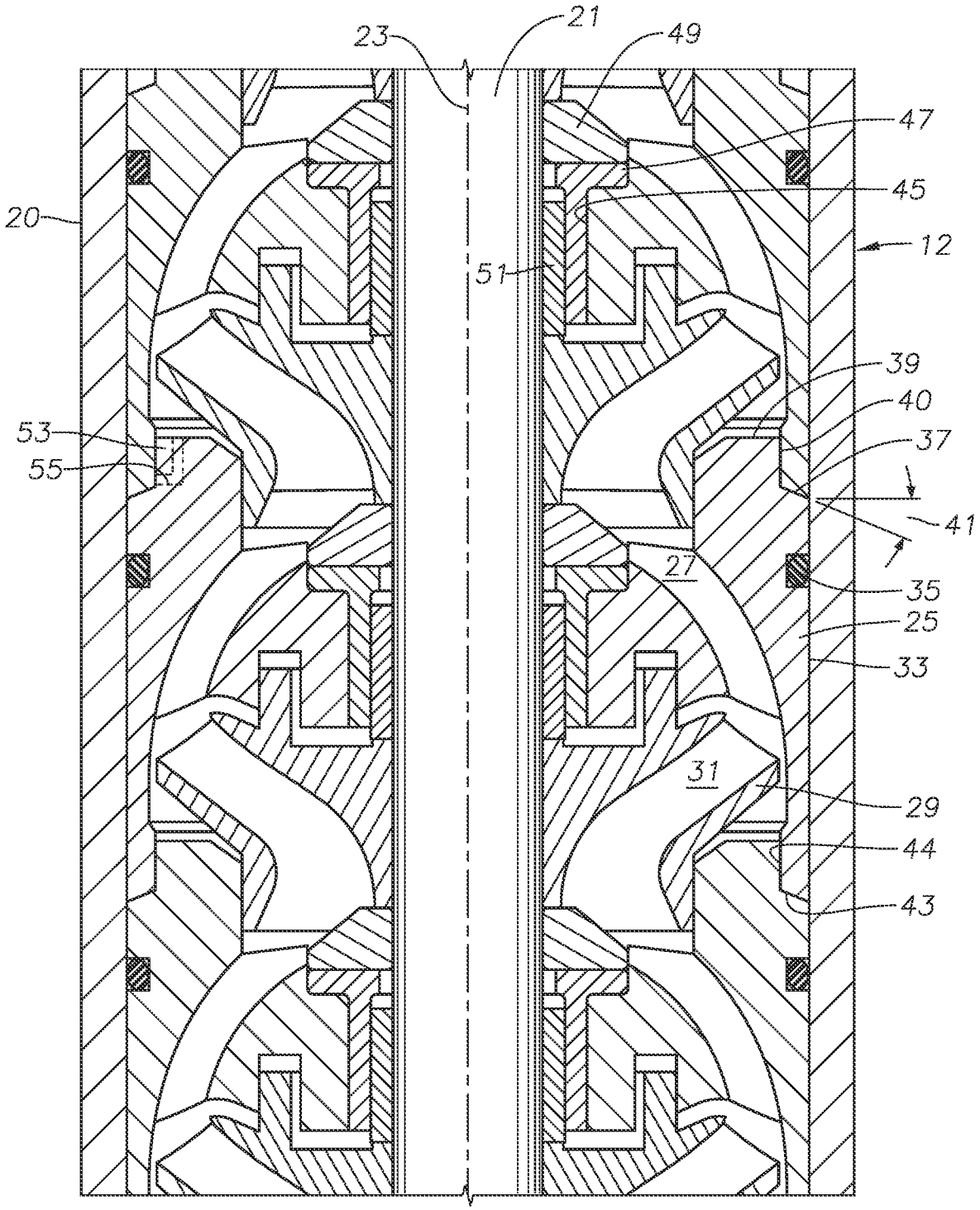
FIG. 2 is an axial sectional of some of the stages of the pump of FIG. 1.

Referring to FIG. 2, pump 12 has a cylindrical housing 20 with a bore through which a drive shaft 21 extends along a longitudinal axis 23. Motor 17 (FIG. 1) operatively couples to drive shaft 21 for causing drive shaft 21 to rotate.

Pump 12 has a non-rotating stack of diffusers 25 that may be identical to each other. FIG. 2 shows only three diffusers 25, but most well pumps will have many more. Each diffuser 25 has diffuser passages 27 that extend upward or downstream and curve inward relative to axis 23. An impeller 29 that rotates with shaft 21 locates between each of the diffusers 25. Each impeller 29 has impeller passages 31 that extend upward and curve outward relative to axis 23. Impeller passages 31 receive well fluid from diffuser passages 27 of a next lower diffuser 25 and deliver the well fluid to diffuser passages 27 of a next upward diffuser 25. A key and slot arrangement between impellers 29 and shaft 21 causes impellers 29 to rotate with shaft 21 but allows slight upward and downward movement of impellers 29 on shaft 21.

Referring also to FIG. 3, which shows only one of the diffusers 25, diffuser 25 has an outer wall 33 that is cylindrical and fits closely within the inner diameter of housing 20. A seal ring 35 optionally fits within an annular groove in outer wall 33 for sealing engagement with the inner diameter of housing 20. Outer wall 33 has an upward facing upper shoulder 37 below an upper end or rim 39 of diffuser 25. Diffuser 25 has a cylindrical neck 40 between upper shoulder 37 and upper end 39 that is smaller in diameter than diffuser outer wall 33. In a prior art design, upper shoulder 37 is flat and in a plane perpendicular to axis 23.

In this embodiment, upper shoulder 37 is a conical surface, taper, or chamfer, rather than being flat. Upper shoulder 37 tapers downward or upstream and outward from neck 40 to outer wall 33. Upper shoulder 37 is a portion of a right, circular cone in this embodiment. A line extending along upper shoulder 37 from neck 40 to outer wall 33 is straight, defining a taper angle 41 that is a range from 10-30 degrees relative to a plane perpendicular to axis 23.

Each diffuser 25 has a lower end, rim or shoulder 43 that abuts in flush contact with upper shoulder 37 of the next lower diffuser 25. Lower shoulder 43 is also a conical surface and has a taper angle that is the same as taper angle 41 of upper shoulder 37. Lower shoulder 43 extends outward and downward or upstream from a lower cylindrical counter bore 44 of diffuser 25 to diffuser outer wall 33. Neck 40 of a next lower diffuser 25 fits closely within lower counter bore 44 of a next upward diffuser 25.

A shaft bearing assembly fits within a diffuser shaft bore 45. In this embodiment, the shaft bearing assembly includes a bushing 47 that is secured against rotation within diffuser shaft bore 45. A pin and groove or a press-fit arrangement may be employed to prevent rotation of bushing 47 with diffuser shaft bore 45. In this example, bushing 47 has an upper end that is T-shaped when viewed in axial cross-section for receiving down thrust from a thrust runner 49. Thrust runner 49 is keyed to shaft 21 for rotation but is able to move short distances axially on shaft 21. A next upward impeller 29 has a lower end that abuts thrust runner 49 to transfer the down thrust caused by the next upward impeller 29 to bushing 47. Bushing 47 transfers the down thrust to the diffuser 25 in which it is mounted, and that diffuser 35 transfers the down thrust to the stack of diffusers 25.

The bearing assembly also includes a bearing sleeve 51 that is keyed for rotation with shaft 21. Bearing sleeve 51 rotates in close sliding engagement with the bore of bushing 47. Bushing 47, thrust runner 49, and bearing sleeve 51 may be formed of a material, such as tungsten carbide, that is harder and more resistant than the material of diffusers 25 and impellers 29.

For assembly, a slight annular clearance will exist between neck 40 of a next lower diffuser 25 and counter bore 44 of the next upward diffuser 25. During assembly, an assembler will slide the next lower diffuser 25 into engagement with the next upward diffuser 25 after the bearing assembly and the next upward impeller 29 have been installed. The conical shapes of shoulders 37, 43 cause the next lower diffuser 25 to self-align with pump axis 23 as the shoulders 37, 43 mate. The self-alignment maintains bearing sleeves 51 in proper alignment with bushings 47, retarding wear that may otherwise occur if some of the diffusers 25 are slightly misaligned with axis 23.

An anti-rotation arrangement between mating diffusers 25 prevents rotation relative to each other. In this example, each diffuser 25 has a lug 53 protruding radially inward in counter bore 44. Lug 53 engages a mating slot 55 within the next lower diffuser 25 to prevent relative rotation. The stack of diffusers 25 will be affixed against rotation in housing 20 in various manners.

Diffusers 25 are also in a pre-loaded compressive engagement each other, retarding well fluid leakage between shoulders 37, 40. A compression device such as top bearing (not shown) above the stack of diffusers 25 has threads that engage threads in the bore of housing 20. A retaining ring may be located at the lower end of the stack of diffusers 25. Tightening the threads exerts a continuing downward compressive force on the stack of diffusers 25. The force is significant, enough to deflect each diffuser 25 in its axial dimension for an amount such as 0.003 inches, for example. The deflection will be elastic, below the yield strength of diffusers 25. The compressive force on shoulders 37, 43 urges lower shoulder 43 to slide outward on upper shoulder 37. Because of the small taper angle of 65-80 degrees relative to a plane perpendicular to axis 23, the compressive force will not cause the lower end of a next upward diffuser 25 to bulge outward over the upper shoulder 37 of the next lower diffuser 25.

Figure 4A:
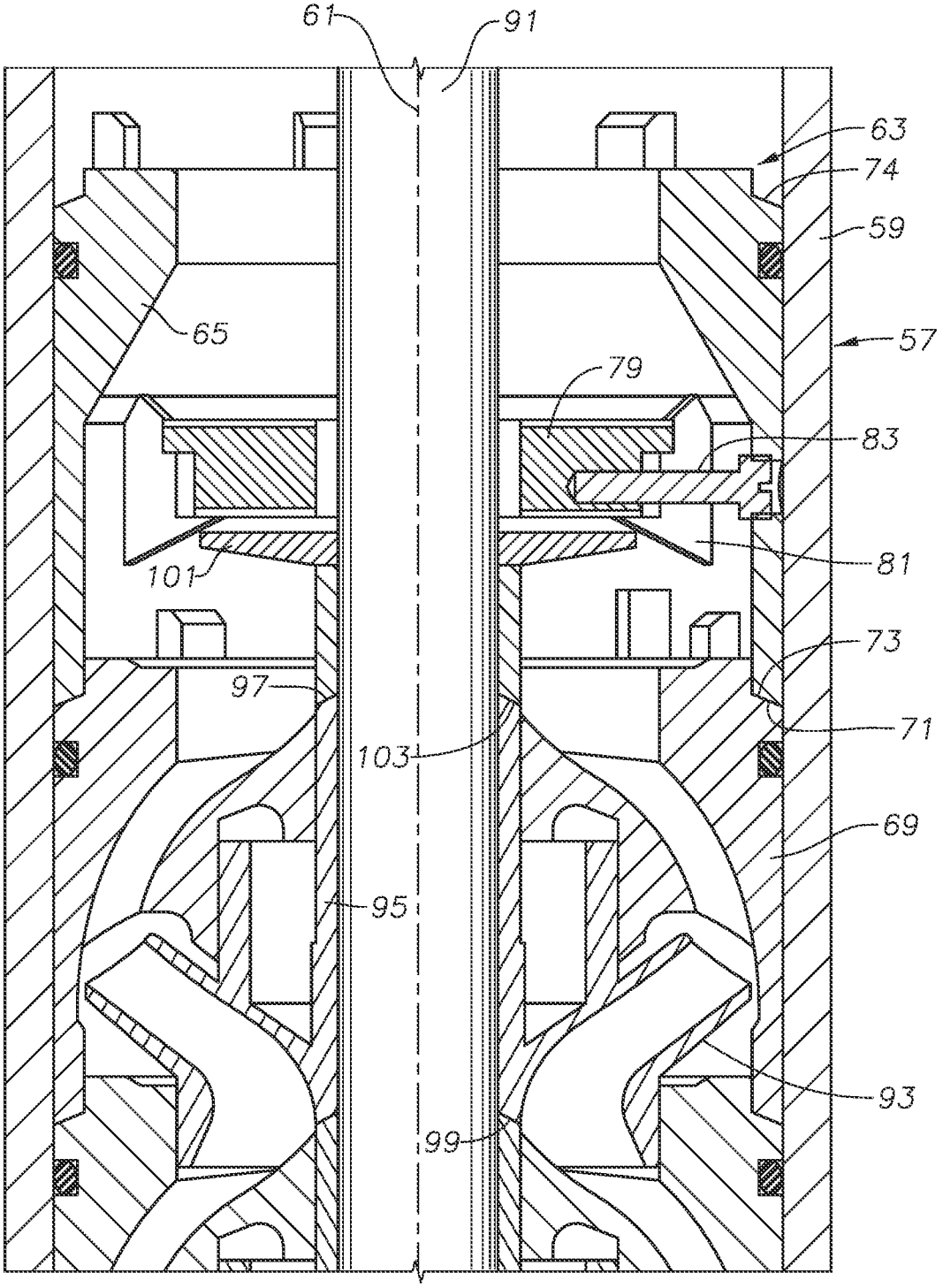
FIGS. 4A and 4B comprise a sectional view of a portion of an alternate embodiment.
Figure 4B:
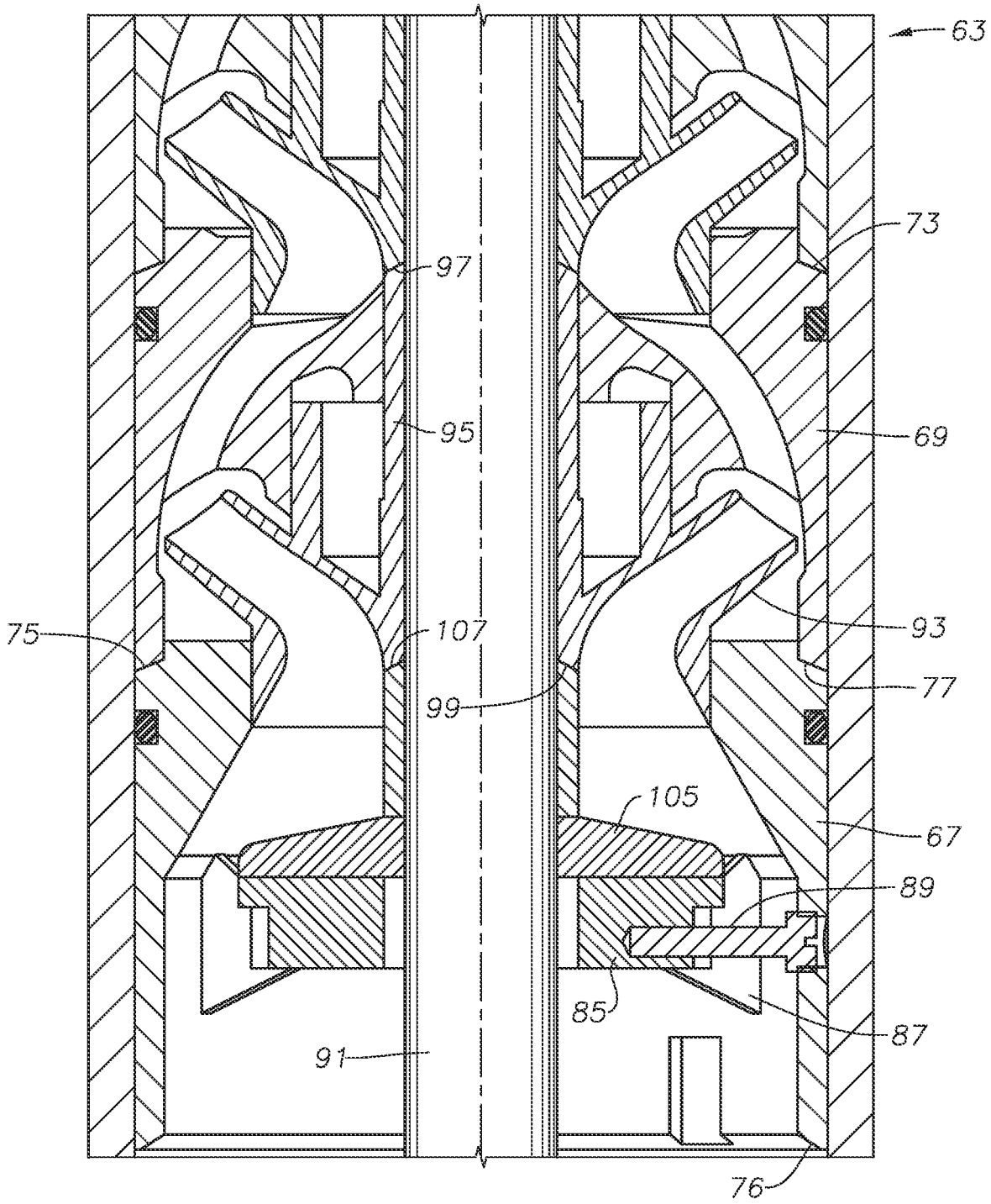

In the first embodiment, as illustrated in FIG. 2, each stage of impeller 29 and diffuser 25 has a separate thrust bearing arrangement with a rotating thrust runner 49 and non-rotating bearing sleeve 51. Each impeller 29 transfers the down thrust that it generates to the next lower diffuser 25 and the up thrust that it generates to the next upper diffuser 25. FIGS. 4A and 4B illustrate a second embodiment in which some of the stages do not have separate thrust bearings.

Pump 57 has a tubular housing 59 with a longitudinal axis 61. Pump 57 has a number of modules 63 (only one shown) within housing 59. Each module 63 has an up thrust shell 65 or up thrust bearing support at its upper end and a down thrust shell 67 (FIG. 4B) or down thrust bearing support at its lower end. A number of diffusers 69 (only three shown) fit between up thrust shell 65 and down thrust shell 67. Up thrust shell 65 has a cylindrical outer wall with a lower shoulder 71 that is conical or tapered and abuts an upper shoulder 73 of the next lower diffuser 69. Up thrust shell 65 has a tapered upper shoulder 74 with a configuration the same as diffuser upper shoulder 73 for engagement by a lower shoulder of a next upper diffuser 69 (not shown).

Down thrust shell 67 has a cylindrical outer wall with an upper shoulder 75 that abuts a lower shoulder 77 of the next upper diffuser 69. Down thrust shell 67 has a lower shoulder 76 that abuts an upper shoulder 73 of a next lower one (not shown) of the diffusers 69. Shoulders 71, 73, 74, 75, 76 and 77 may be configured the same as in the first embodiment and with the same taper angles. The stack of diffusers 69 and thrust shells 71, 75 is compressed axially with the other modules 63 in the same manner as in the first embodiment. For example, a threaded nut or bearing (not shown) at the upper end of pump 57 exerts a compressive force on the stack of modules 63 that is reacted by a retaining ring at the lower end of pump 57.

Up thrust shell 65 provides support for an up thrust bearing 79 and transfers up thrust into the stack of diffusers 69 located above it. Up thrust bearing 79 has a flat downward facing bearing surface and is supported in up thrust shell 65 by gussets or fins 81 extending inward from the outer wall of up thrust shell 65. A plurality of pins 83 (only one shown) extend through the outer wall of up thrust shell 65 into threaded engagement with up thrust bearing 79. Pins 83 secure up thrust bearing 79 to up thrust shell 65, preventing rotational and axial movement relative to pump housing 59.

Similarly, down thrust shell 67 provides support for a down thrust bearing 85 and transfers down thrust into the stack of diffusers 69 located below it. Down thrust bearing 85 has a flat upward facing bearing surface and is supported in down thrust shell 67 by gussets or fins 87 extending inward from the outer wall of down thrust shell 67. Pins 89 extend through the outer wall of down thrust shell 67 into threaded engagement with down thrust bearing 85.

A rotatable drive shaft 91 extends through housing 59 on axis 61. A number of impellers 93 (only three shown) are located between up thrust shell 65 and down thrust shell Each impeller 93 has a central hub 95 with a bore through which shaft 91 passes. Each hub 95 mounts to shaft 91 for rotation in unison, but is able to move axially slight distances on shaft 91 between down thrust and up thrust conditions. Each hub 95 may be integrally formed with one of the impellers 93 and has an upper conical or tapered end 97 and a lower conical or tapered end 99. Upper end 97 slopes downward and outward from the upper extremity of hub 95. Lower end 99 slopes downward and outward to the lower extremity of hub 95. The taper angle for upper and lower ends 97, 99 may be the same as the taper angle for upper and lower shell shoulders 71, 73, 74, 75 and 77. Although hubs 95 are illustrated as being a single-piece member, each formed with one of the impellers 93, they could be in multiple pieces. For example, a separate spacer sleeve could form a part of each hub 95.

An up thrust runner 101 has a tapered lower end 103 that abuts the tapered upper end 97 of the upper most hub 95 in module 63. In this embodiment, up thrust runner 101 is illustrated as being in two pieces, the upper portion of which is a flat disk and the lower portion a tubular sleeve. However, up thrust runner 101 could be a single piece. The flat upper side of up thrust runner 101 is a short distance below up thrust bearing 79 when impellers 95 are undergoing down thrust. When impellers 93 in module 63 undergo up thrust, hubs 95 transfer the up thrust to one another and to up thrust runner 101. From up thrust runner 101, the up thrust transfers to up thrust bearing 79, up thrust shell 65 and the stack of diffusers 69 above up thrust shell 65.

A down thrust runner 105 has a tapered upper end 107 that abuts the tapered lower end 99 of the lower most hub 95 in module 63. In this embodiment, down thrust runner 105 is illustrated as being in two pieces, the lower portion of which is a flat disk and the upper portion a tubular sleeve. However, down thrust runner 105 could be a single piece. When impellers 93 in module 63 undergo down thrust, hubs 95 transfer the down thrust from the impellers 93 in module 63 to down thrust runner 105 and from down thrust runner 105 to down thrust bearing 85. Down thrust bearing 85 transfers the down thrust through down thrust shell 67 and the stack of diffusers 69 below down thrust shell 67.

During up thrust, the conical ends 97, 99 of adjacent impeller hubs 95 abut each other, except the upper end 97 of the upper most hub 95, which abuts up thrust runner 101. Similarly, during down thrust, the conical ends 97, 99 of adjacent impeller hubs 95 abut each other, except the lower end 99 of the lower most hub 95, which abuts down thrust runner 105.

The lengths of impeller hubs 95 and down thrust runner 105 are selected so that down thrust from the upper most impeller 93 in module 63 transfers from one hub 95 to the next and from the lower most to down thrust runner 105 and down thrust bearing 85. During down thrust a clearance will remain between each impeller 93 and its mating next lower diffuser 69 that prevents any of the down thrust from passing directly from the impeller 93 to its mating lower diffuser 69. Similarly, during up thrust, a clearance will remain between each impeller 93 and its mating next upper diffuser 69 that prevents any of the up thrust from passing directly from the impeller 93 to its mating upper diffuser 69.

The present disclosure described herein, therefore, is well adapted to carry out the objects and attain the ends and advantages mentioned, as well as others inherent therein. While only two embodiments of the disclosure has been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. An electrical submersible pump for pumping well fluid, comprising:

a housing having a longitudinal axis;

a plurality of diffusers within the housing, each of the plurality of diffusers having a conical upper shoulder and a conical lower shoulder, the shoulders formed along an outer periphery of each of the plurality of diffusers, the plurality of diffusers arranged into a stack by stacking the lower shoulder of each of the plurality of diffusers into direct and abutting contact with the upper shoulder of an adjacent lower diffuser of the plurality of diffusers and are in a pre-loaded compressive engagement to define a fluid barrier between abutting shoulders; and a drive shaft extending through the housing along the axis;

a plurality of impellers, each having a hub mounted to the shaft for rotation in unison and axially movable relative to the shaft;

each of the hubs having conical upper and lower ends, wherein at least some of the upper ends of the hubs abut and transfer an up thrust to the lower end of an adjacent upper one of the hubs, and at least some of the lower ends of the hubs abut and transfer a down thrust to the upper end of an adjacent lower one of the hubs; and a neck formed adjacent to and radially inward from each of the upper shoulders and having a rim on an axial terminal end, so that when the plurality of diffusers are arranged into the stack of plurality of diffusers the neck is circumscribed by the upper and lower shoulders, and the rim extends past the lower shoulder on an adjacent upper one of the diffusers of the plurality of diffusers.

2. The pump according to claim 1, wherein a taper angle of the upper shoulder and of the lower shoulder of each of the plurality of diffusers is in a range from 10 to 30 degrees relative to a plane perpendicular to the axis.

3. The pump according to claim 1, wherein:

the upper shoulder and the lower shoulder of each of the plurality of diffusers slope downward and outward relative to the axis.

4. The pump according to claim 1, wherein:

a counter-bore is formed into a lower end of each of the plurality of diffusers that is spaced radially inward from an outer surface of the plurality of diffusers to define an inner wall on the lower end;

the lower end of each of the plurality of diffusers slides over the neck of the adjacent lower one of the plurality of diffusers so that the counter-bore receives the neck; and wherein the conical shapes of the upper and lower shoulders cause the plurality of diffusers to self-align with the axis as the shoulders mate with one another.

5. The pump according to claim 1, further comprising:

an up thrust runner mounted to the shaft for rotation in unison, the up thrust runner having a conical lower end that is abutted by the upper end of an adjacent lower one of the hubs;

an up thrust bearing mounted in the housing for non-rotation relative to the housing, the up thrust bearing having a lower side that is abutted by the up thrust runner during the up thrust;

a down thrust runner that is mounted to the shaft for rotation in unison, the down thrust runner having a conical upper end that is abutted by the lower end of an adjacent upper one of the hubs; and a down thrust bearing mounted in the housing for non-rotation relative to the housing, the down thrust bearing having an upper side that is abutted by the down thrust runner during the down thrust.

6. The pump according to claim 1, further comprising:

an up thrust runner mounted to the shaft for rotation in unison, the up thrust runner having a conical lower end that is abutted by the upper end of an adjacent lower one of the hubs;

a down thrust runner mounted to the shaft for rotation in unison, the down thrust runner having a conical upper end that is abutted by the lower end of an adjacent upper one of the hubs; and means for transferring the up thrust from the up thrust runner to the housing and for transferring the down thrust from the down thrust runner to the housing.

7. The pump according to claim 1, further comprising:

an up thrust shell mounted in the stack of the plurality of diffusers between two of the plurality of diffusers and above at least one of the plurality of impellers, the up thrust shell having an outer wall with conical upper and lower shoulders, the upper shoulder of the up thrust shell being in abutment with the lower shoulder of an adjacent upper one of the plurality of diffusers, the lower shoulder of the up thrust shell being in abutment with the upper shoulder of an adjacent lower one of the plurality of diffusers;

an up thrust runner mounted to the shaft for rotation in unison, the up thrust runner having a conical lower end that is abutted by the upper end of an adjacent lower one of the hubs;

an up thrust bearing mounted in the up thrust shell for non-rotation with the shaft, the up thrust bearing being engaged by the up thrust runner during the up thrust for transferring the up thrust to the up thrust shell and the stack of the plurality of diffusers;

a down thrust shell mounted in the stack of the plurality of diffusers between two of the plurality of diffusers and below at least one of the plurality of impellers, the down thrust shell having an outer wall with conical upper and lower shoulders, the upper shoulder of the down thrust shell being in abutment with the lower shoulder of an adjacent upper one of the plurality of diffusers, the lower shoulder of the down thrust shell being in abutment with the upper shoulder of an adjacent lower one of the plurality of diffusers;

a down thrust runner mounted to the shaft for rotation in unison, the down thrust runner having a conical upper end that is abutted by the lower end of an adjacent upper one of the hubs; and a down thrust bearing mounted in the down thrust shell for non-rotation with the shaft, the down thrust bearing being abutted by the down thrust runner during the down thrust for transferring the down thrust to the down thrust shell and the stack of the plurality of diffusers.

8. The pump according to claim 7, wherein:

the lower end of the up thrust runner, the upper end of the down thrust runner, and the upper and lower shoulders of each of the up thrust and down thrust shells slope downward and outward relative to the axis.

9. The pump according to claim 7, wherein:

a taper angle of the lower end of the up thrust runner, the upper end of the down thrust runner and each of the shoulders of the up thrust and down thrust shells is in a range from 10 to 30 degrees relative to a plane perpendicular to the axis.

10. An electrical submersible pump for pumping well fluid, comprising:

a housing having a longitudinal axis;

a stack of diffusers stacked on top of each other within the housing, each of the diffusers having a tapered upper shoulder and a tapered lower shoulder:

the lower shoulder of each of the diffusers being in abutment with the upper shoulder of an adjacent lower one of the diffusers;

a drive shaft extending through the housing along the axis;

a plurality of impellers, each having a hub mounted to the shaft for rotation in unison and axially movable relative to the shaft;

each of the hubs having tapered upper and lower ends; wherein at least some of the upper ends of the hubs abut and transfer an up thrust to the lower end of an adjacent upper one of the hubs; and at least some of the lower ends of the hubs abut and transfer a down thrust to the upper end of an adjacent lower one of the hubs.

11. The pump according to claim 10, wherein:

an upper end of each of the diffusers has a rim, and the upper shoulder of each of the diffusers is spaced below the rim, defining a neck extending from the upper shoulder to the rim; and a lower end of each of the diffusers slides over the neck of the adjacent lower one of the diffusers.

12. The pump according to claim 10, further comprising:

an up thrust runner mounted to the shaft for rotation in unison, the up thrust runner having a tapered lower end that is abutted by the upper end of an adjacent lower one of the hubs during up thrust conditions;

a down thrust runner mounted to the shaft for rotation in unison, the down thrust runner having a tapered upper end that is abutted by the lower end of an adjacent upper one of the hubs during down thrust conditions; and means for transferring the up thrust from the up thrust runner to the housing and for transferring the down thrust from the down thrust runner to the housing.

13. The pump according to claim 12, wherein:

the hubs and the down thrust runner are sized to prevent each of the plurality of impellers from directly transferring the down thrust to an adjacent lower one of the diffusers; and the hubs and the up thrust runner are sized to prevent each of the plurality of impellers from directly transferring the up thrust to an adjacent upper one of the diffusers.

14. The pump according to claim 10, further comprising:

an up thrust shell mounted in the stack of diffusers between two of the diffusers and above at least one of the plurality of impellers, the up thrust shell having an outer wall with tapered upper and lower shoulders, the upper shoulder of the up thrust shell being in abutment with the lower shoulder of an adjacent upper one of the diffusers, the lower shoulder of the up thrust shell being in abutment with the upper shoulder of an adjacent lower one of the diffusers;

an up thrust runner mounted to the shaft for rotation in unison, the up thrust runner having a tapered lower end that is abutted by the upper end of an adjacent lower one of the hubs;

an up thrust bearing mounted in the up thrust shell for non-rotation with the shaft, the up thrust bearing surface being engaged by the up thrust runner during the up thrust for transferring the up thrust to the up thrust shell and the stack of diffusers;

a down thrust shell mounted in the stack of diffusers between two of the diffusers and below at least one of the plurality of impellers, the down thrust shell having an outer wall with tapered upper and lower shoulders, the upper shoulder of the down thrust shell being in abutment with the lower shoulder of an adjacent upper one of the diffusers, the lower shoulder of the down thrust shell being in abutment with the upper shoulder of an adjacent lower one of the diffusers;

a down thrust runner mounted to the shaft for rotation in unison, the down thrust runner having a tapered upper end that is abutted by the lower end of an adjacent upper one of the hubs; and a down thrust bearing mounted in the down thrust shell for non-rotation with the shaft, the down thrust bearing being abutted by the down thrust runner during the down thrust for transferring the down thrust to the lower shell and the stack of diffusers.

15. The pump according to claim 14, wherein the plurality of the impellers are located between the up thrust runner and the down thrust runner.

16. An electrical submersible pump for pumping well fluid, comprising:

a housing having a longitudinal axis;

a stack of diffusers within the housing, each of the diffusers having a tapered upper shoulder and a tapered lower shoulder, the lower shoulder of each of the diffusers being in abutment with the upper shoulder of an adjacent lower one of the diffusers;

an up thrust shell mounted in the stack of diffusers, the up thrust shell having an outer wall with tapered upper and lower shoulders, the upper shoulder of the up thrust shell being in abutment with the lower shoulder of an adjacent upper one of the diffusers, the lower shoulder of the up thrust shell being in abutment with the upper shoulder of an adjacent lower one of the diffusers;

a down thrust shell mounted in the stack of diffusers below the up thrust shell, at least two of the diffusers being between the up thrust shell and the down thrust shell, the down thrust shell having an outer wall with tapered upper and lower shoulders, the upper shoulder of the down thrust shell being in abutment with the lower shoulder of an adjacent upper one of the diffusers, the lower shoulder of the down thrust shell being in abutment with the upper shoulder of an adjacent lower one of the diffusers;

a drive shaft extending through the housing along the axis;

a plurality of impellers between the up thrust shell and the down thrust shell, each having a hub mounted to the shaft for rotation in unison and axially movable relative to the shaft, each of the hubs having tapered upper and lower ends; wherein at least some of the upper ends of the hubs abut and transfer an up thrust to the lower end of an adjacent upper one of the hubs;

at least some of the lower ends of the hubs abut and transfer a down thrust to the upper end of an adjacent lower one of the hubs;

an up thrust runner mounted to the shaft for rotation in unison, the up thrust runner having a tapered lower end that is abutted by the upper end of an adjacent lower one of the hubs;

an up thrust bearing mounted in the up thrust shell for non-rotation with the shaft, the up thrust bearing being engaged by the up thrust runner during the up thrust for transferring the up thrust to the up thrust shell and the stack of diffusers;

the down thrust shell mounted in the stack of diffusers between two of the diffusers and below at least one of the plurality of the impellers;

a down thrust runner mounted to the shaft for rotation in unison, the down thrust runner having a tapered upper end that is abutted by the lower end of an adjacent upper one of the hubs; and a down thrust bearing mounted in the down thrust shell for non-rotation with the shaft, the down thrust bearing being abutted by the down thrust runner during the down thrust for transferring the down thrust to the stack of diffusers.

17. The pump according to claim 16, wherein:

a taper angle of the lower end of the up thrust runner, the upper end of the lower thrust runner and each of the shoulders of the up thrust and down thrust shells is in a range from 10 to 30 degrees relative to a plane perpendicular to the axis.

18. The pump according to claim 16, wherein:

the hubs and the down thrust runner have lengths selected to prevent each of the plurality of the impellers between the up thrust shell and the down thrust shell from directly transferring the down thrust to the adjacent lower one of the diffusers between the up thrust shell and the down thrust shell; and the hubs and the up thrust runner have lengths selected to prevent each of the plurality of impellers between the up thrust shell and the down thrust shell from directly transferring the up thrust to the adjacent upper one of the diffusers between the up thrust shell and the down thrust shell.

19. The pump according to claim 16, wherein:

the lower end of the up thrust runner, the upper end of the down thrust runner, and each of the upper and lower shoulders of the up thrust and down thrust shells slope downward and outward relative to the axis.

* * * * *